US008591221B2

(12) United States Patent
Schultz

(10) Patent No.: US 8,591,221 B2
(45) Date of Patent: Nov. 26, 2013

(54) COMBUSTION BLOWER CONTROL FOR MODULATING FURNACE

(75) Inventor: Michael W. Schultz, Elk River, MN (US)

(73) Assignee: Honeywell International Inc.

( * ) Notice: Subject to any disclaimer, the term of this patent is extended or adjusted under 35 U.S.C. 154(b) by 1591 days.

(21) Appl. No.: 12/123,333

(22) Filed: May 19, 2008

(65) Prior Publication Data

US 2008/0213710 A1 Sep. 4, 2008

Related U.S. Application Data

(63) Continuation-in-part of application No. 11/550,775, filed on Oct. 18, 2006.

(51) Int. Cl.
*F23N 1/00* (2006.01)

(52) U.S. Cl.
USPC ..... 431/12; 431/20; 431/89; 431/90; 126/116 A; 137/87.01

(58) Field of Classification Search
USPC ..... 431/12, 89, 20, 90; 126/116 A; 137/87.01
See application file for complete search history.

(56) References Cited

U.S. PATENT DOCUMENTS 3,967,504 A * 7/1976 Akeley ..... 73/722
4,251,025 A 2/1981 Bonne et al.
4,314,441 A 2/1982 Yannone et al.
4,329,138 A 5/1982 Riordan
4,334,855 A 6/1982 Nelson
4,340,355 A 7/1982 Nelson et al.
4,373,897 A 2/1983 Torborg
4,439,139 A 3/1984 Nelson et al.
4,502,625 A 3/1985 Mueller
4,533,315 A 8/1985 Nelson
4,547,144 A * 10/1985 Dietiker et al. ..... 431/20
4,684,060 A 8/1987 Adams et al.
4,688,547 A 8/1987 Ballard et al.
4,703,795 A 11/1987 Beckey
4,708,636 A 11/1987 Johnson
4,729,207 A 3/1988 Dempsey et al.
4,767,104 A 8/1988 Plesinger (Continued)

OTHER PUBLICATIONS

Honeywell, "45.801.175, Amplification Gas/Air Module for VK4105R/VK8105R Gas Controls," Production Handbook, 8 pages, prior to Oct. 18, 2006.

(Continued)

*Primary Examiner* — Avinash Savani
(74) *Attorney, Agent, or Firm* — Seager Tufte & Wickhem LLC

(57) ABSTRACT

A forced air furnace may include a pneumatically modulated gas valve that is configured to provide gas to a burner. A pneumatic sampling device may be disposed proximate a combustion blower and may be configured to provide the pneumatically modulated gas valve with a first pneumatic signal and a second pneumatic signal that are representative of fluid flow through the pneumatic sampling device. The pneumatically modulated gas valve may regulate gas flow in accordance with the first and second pneumatic signals. In some cases, the pneumatic sampling device may include a restriction, a first pressure port disposed upstream of the restriction and a second pressure port disposed downstream of the restriction. The first and second pressure ports may provide the first and second pneumatic signals to the pneumatically modulated gas valve.

21 Claims, 6 Drawing Sheets

(56) References Cited

U.S. PATENT DOCUMENTS

| | | | | |
|---|---|---|---|---|
| 4,819,587 | A | 4/1989 | Tsutsui et al. | |
| 4,892,245 | A | 1/1990 | Dunaway et al. | |
| 4,915,615 | A | 4/1990 | Kawamura et al. | |
| 5,026,270 | A | 6/1991 | Adams et al. | |
| 5,248,083 | A | 9/1993 | Adams et al. | |
| 5,307,990 | A | 5/1994 | Adams et al. | |
| 5,331,944 | A | 7/1994 | Kujawa et al. | |
| 5,340,028 | A | 8/1994 | Thompson | |
| 5,347,981 | A | 9/1994 | Southern et al. | |
| 5,408,986 | A | 4/1995 | Bigham | |
| 5,513,979 | A * | 5/1996 | Pallek et al. | 431/90 |
| 5,520,533 | A | 5/1996 | Vrolijk | |
| 5,590,642 | A | 1/1997 | Borgeson et al. | |
| 5,630,408 | A | 5/1997 | Versluis | |
| 5,720,231 | A | 2/1998 | Rowlette et al. | |
| 5,732,691 | A | 3/1998 | Maiello et al. | |
| 5,791,332 | A | 8/1998 | Thompson et al. | |
| 5,806,440 | A | 9/1998 | Rowlette et al. | |
| 5,819,721 | A | 10/1998 | Carr et al. | |
| 5,860,411 | A | 1/1999 | Thompson et al. | |
| 5,865,611 | A | 2/1999 | Maiello | |
| 5,993,195 | A | 11/1999 | Thompson | |
| 6,000,622 | A | 12/1999 | Tonner et al. | |
| 6,109,255 | A | 8/2000 | Dieckmann et al. | |
| 6,254,008 | B1 | 7/2001 | Erickson et al. | |
| 6,257,870 | B1 | 7/2001 | Hugghins et al. | |
| 6,283,115 | B1 | 9/2001 | Dempsey et al. | |
| 6,321,744 | B1 | 11/2001 | Dempsey et al. | |
| 6,354,327 | B1 | 3/2002 | Mayhew | |
| 6,377,426 | B2 | 4/2002 | Hugghins et al. | |
| 6,561,791 | B1 * | 5/2003 | Vrolijk et al. | 431/12 |
| 6,571,817 | B1 | 6/2003 | Bohan, Jr. | |
| 6,705,533 | B2 | 3/2004 | Casey et al. | |
| 6,749,423 | B2 | 6/2004 | Fredricks et al. | |
| 6,758,909 | B2 | 7/2004 | Jonnalagadda et al. | |
| 6,764,298 | B2 | 7/2004 | Kim et al. | |
| 6,793,015 | B1 | 9/2004 | Brown et al. | |
| 6,846,514 | B2 | 1/2005 | Jonnalagadda et al. | |
| 6,866,202 | B2 | 3/2005 | Sigafus et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 6,925,999 | B2 | 8/2005 | Hugghins et al. | |
| 7,055,759 | B2 | 6/2006 | Wacker et al. | |
| 7,101,172 | B2 | 9/2006 | Jaeschke | |
| 7,111,503 | B2 | 9/2006 | Brumboiu et al. | |
| 2002/0155405 | A1 | 10/2002 | Casey et al. | |
| 2003/0011342 | A1 | 1/2003 | Eichorn | |
| 2005/0155404 | A1 | 7/2005 | Geho et al. | |
| 2005/0159844 | A1 | 7/2005 | Sigafus et al. | |
| 2006/0105279 | A1 | 5/2006 | Munsterhuis et al. | |

OTHER PUBLICATIONS

Honeywell, "VK41..R/VK81..R Series, Gas Controls with Integrated Gas/Air Module for Combined Valve and Ignition System," Instruction Sheet, 6 pages, prior to Oct. 18, 2006.

http://www.regal-beloit.com/gedraft.html, "Welcome to GE Commercial Motors by Regal-Beloit," 1 page, printed Apr. 26, 2006.

Lennox, "G61MPV Series Units," Installation Instructions, 2 pages, Oct. 2006.

* cited by examiner

COMBUSTION BLOWER CONTROL FOR MODULATING FURNACE

This application is a continuation-in-part (CIP) of co-pending U.S. patent application Ser. No. 11/550,775, filed on Oct. 18, 2006, and entitled "SYSTEMS AND METHODS FOR CONTROLLING GAS PRESSURE TO GAS-FIRED APPLIANCES", the entire disclosure of which is incorporated herein by reference.

TECHNICAL FIELD

The present invention relates generally to the field of gas-fired appliances. More specifically, the present invention pertains to systems and methods for controlling gas pressure to gas-fired appliances such as warm air furnaces.

BACKGROUND

Warm air furnaces are frequently used in homes and office buildings to heat intake air received through return ducts and distribute heated air through warm air supply ducts. Such furnaces typically include a circulation blower or fan that directs cold air from the return ducts across a heat exchanger having metal surfaces that act to heat the air to an elevated temperature. A gas burner is used for heating the metal surfaces of the heat exchanger. The air heated by the heat exchanger can be discharged into the supply ducts via the circulation blower or fan, which produces a positive airflow within the ducts. In some designs, a separate combustion blower can be used to remove exhaust gasses resulting from the combustion process through an exhaust vent.

In a conventional warm air furnace system, gas valves are typically used to regulate gas pressure supplied to the burner unit at specific limits established by the manufacturer and/or by industry standard. Such gas valves can be used, for example, to establish an upper gas flow limit to prevent over-combustion or fuel-rich combustion within the appliance, or to establish a lower limit to prevent combustion when the supply of gas is insufficient to permit proper operation of the appliance. In some cases, the gas valve regulates gas pressure independent of the combustion blower. This may permit the combustion blower to be overdriven to overcome a blocked vent or to compensate for pressure drops due to long vent lengths without exceeding the maximum gas firing rate of the furnace.

In some designs, the gas valve may be used to modulate the gas firing rate within a particular range in order to vary the amount of heating provided by the appliance. Modulation of the gas firing rate may be accomplished, for example, via pneumatic signals received from the heat exchanger, or from electrical signals received from a controller tasked to control the gas valve. While such techniques are generally capable of modulating the gas firing rate, such modulation is usually accomplished via control signals that are independent from the control of the combustion air flow. In some two-stage furnaces, for example, the gas valve may output gas pressure at two different firing rates based on control signals that are independent of the actual combustion air flow produced by the combustion blower. Since the gas control is usually separate from the combustion air control, the delivery of a constant gas/air mixture to the burner unit may be difficult or infeasible over the entire range of firing rate.

To overcome this problem, attempts to link the speed of the combustion blower to the gas firing rate have been made, but with limited efficacy. In one such solution, for example, the fan shaft of the combustion blower is used as a pump to create an air signal that can be used by the gas valve to modulate gas pressure supplied to the burner unit. Such air signal, however, is proportional to the fan shaft speed and not the actual combustion air flow, which can result in an incorrect gas/air ratio should the vent or heat exchanger become partially or fully obstructed. In some cases, such system may result in a call for more gas than is actually required, reducing the efficiency of the combustion process.

In another common modulating technique in which zero-governing gas pressure regulators and pre-mix burners are used to completely mix gas and air prior to delivery to the burner unit, an unamplified (i.e. 1:1 pressure ratio) pressure signal is sometimes used to modulate the gas valve. Such solutions, while useful in gas-fired boilers and water heaters, are often not acceptable in warm air furnaces where in-shot burners are used and positive gas pressures are required.

Other factors such as complexity and energy usage may also reduce the efficiency of the gas-fired appliance in some cases. In some conventional multi-stage furnaces, for example, the use of additional wires for driving additional actuators on the gas valve for each firing rate beyond single-stage may require more power to operate, and are often more difficult to install and control. Depending on the type of modulating actuators employed, hysteresis caused by the actuator's armature traveling through its range of motion may also cause inaccuracies in the gas flow output during transitions in firing rate.

SUMMARY

The present invention pertains to systems and methods for controlling gas pressure to gas-fired appliances such as warm air furnaces. An illustrative system can include a pneumatically modulated gas valve adapted to supply gas to a burner unit, a multi speed or variable speed combustion blower adapted to produce a combustion air flow for combustion at the burner unit, a pneumatic sampling device in fluid communication with the pneumatically modulated gas valve, and a controller for controlling the speed of the combustion blower. The pneumatic sampling device may be disposed proximate the combustion blower, and in some cases, proximate the upstream inlet of the combustion blower. The pneumatic sampling device may be configured to provide the pneumatically modulated gas valve with a first pneumatic signal and a second pneumatic signal that are representative of fluid flow through the pneumatic sampling device. The pneumatically modulated gas valve may regulate gas flow in accordance with the first and second pneumatic signals.

In one illustrative embodiment, the pneumatic sampling device may include a restriction that is in fluid communication with the combustion blower. A first pressure port may be disposed upstream of the restriction while a second pressure port may be disposed downstream of the restriction. During use, the first pressure port and the second pressure port may be in fluid communication with the pneumatically modulated gas valve, and may deliver a differential pressure signal to the pneumatically modulated gas valve. The pneumatically modulated gas valve may be controlled in accordance with the first pneumatic signal and the second pneumatic signal in order to modulate gas flow to the burner. The speed of the combustion blower may be adjusted to control the firing rate of the gas supplied to the burner unit. By pneumatically linking the gas valve to the actual combustion air flow produced by the combustion blower via the pneumatic sampling device, the gas valve can be operated over a wide range of firing rates by simply adjusting the speed of the combustion blower.

In some cases, the pneumatic sampling device may be secured, sometimes removably secured, to the inlet and/or outlet of the combustion blower. In other cases, the pneumatic sampling device may be integral with and formed as part of the combustion blower housing, and in some cases, integral with and formed as part of the inlet and/or outlet of the combustion blower housing. However, these are just examples. It is contemplated that the pneumatic sampling device may be placed at various locations within the combustion air flow stream, including either upstream or downstream of the combustion blower.

The above summary is not intended to describe each disclosed embodiment or every implementation. The Figures, Detailed Description and Examples which follow more particularly exemplify these embodiments.

BRIEF DESCRIPTION

The disclosure may be more completely understood in consideration of the following detailed description of various embodiments in connection with the accompanying drawings, in which.

Figure 1:
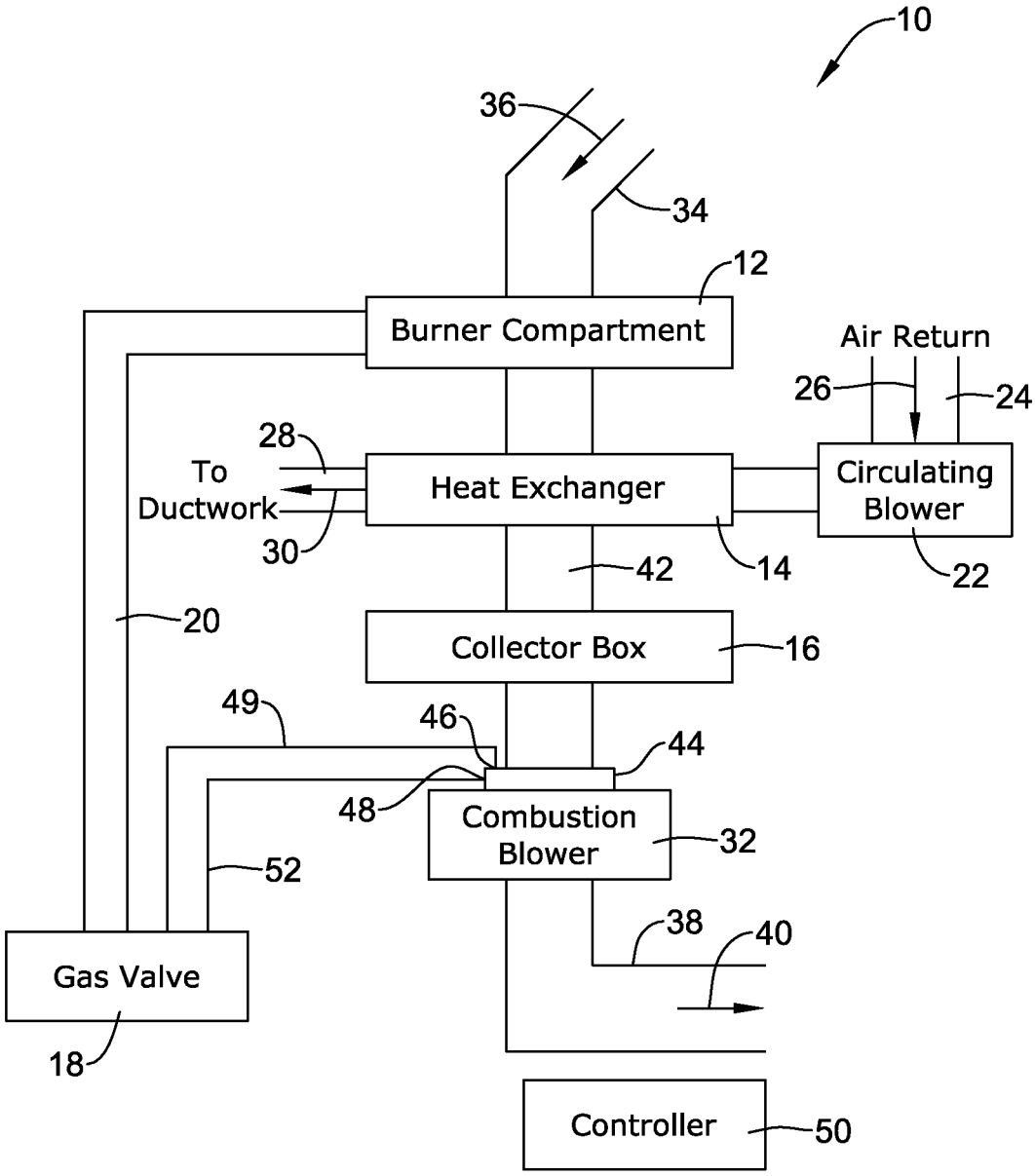
FIG. 1 is a diagrammatic view of an illustrative but non-limiting furnace.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DESCRIPTION

The following description should be read with reference to the drawings, in which like elements in different drawings are numbered in like fashion. The drawings, which are not necessarily to scale, depict selected embodiments and are not intended to limit the scope of the invention. Although examples of systems and methods are illustrated in the various views, those skilled in the art will recognize that many of the examples provided have suitable alternatives that can be utilized. While the systems and methods are described with respect to warm air furnaces, it should be understood that the gas valves and systems described herein could be applied to the control of other gas-fired appliances, if desired. Examples of other gas-fired appliances that can be controlled can include, but are not limited to, water heaters, fireplace inserts, gas stoves, gas clothes dryers, gas grills, or any other such device where gas control is desired. Typically, such appliances utilize fuels such as natural gas or liquid propane gas as the primary fuel source, although other liquid and/or gas fuel sources may be provided depending on the type of appliance to be controlled.

FIG. 1 is a highly diagrammatic illustration of a furnace 10, which may include additional components not described herein. The primary components of furnace 10 include a burner 12, a heat exchanger 14 and a collector box 16. A gas valve 18 provides fuel such as natural gas or propane, from a source (not illustrated) to burner 12 via a gas line 20. In some cases, as will be discussed below, gas valve 18 may be considered as being a pneumatically modulated gas valve in which relative gas flow is dictated at least in part upon an incident pneumatic signal. This is in contrast to an electrically modulated gas valve in which relative gas flow is dictated at least in part upon an electrical signal from a controller or the like.

Burner 12 burns the fuel provided by gas valve 18, and provides heated combustion products to heat exchanger 14. The heated combustion products pass through heat exchanger 14 and exit into collector box 16, which are ultimately exhausted (not illustrated) to the exterior of the building or home in which furnace 10 is installed. A circulating blower 22 accepts return air from the building or home's return ductwork 24 as indicated by arrow 26 and blows the return air through heat exchanger 14, thereby heating the air. The heated air then exits heat exchanger 14 and enters the building or home's conditioned air ductwork 28, traveling in a direction indicated by arrow 30. For enhanced thermal transfer and efficiency, the heated combustion products may pass through heat exchanger 14 in a first direction while circulating blower 22 forces air through heat exchanger 14 in a second direction. In some instances, for example, the heated combustion products may pass downwardly through heat exchanger 14 while the air blown through by circulating blower 22 may pass upwardly through heat exchanger 14, but this is not required.

In some cases, as illustrated, a combustion blower 32 may be positioned downstream of collector box 16 and may pull combustion gases through heat exchanger 14 and collector box 16. Combustion blower 32 may be considered as pulling air into burner 12 through combustion air source 34 to provide an oxygen source for supporting combustion within burner compartment 12. The combustion air may move in a direction indicated by arrow 36. Combustion products may then pass through heat exchanger 14, into collector box 16, and ultimately through a flue 38 in a direction indicated by arrow 40. A combustion gas flow path 42 may be considered as extending from burner 12, through heat exchanger 14, through collector box 16, through combustion blower 32 and out flue 38.

It should be recognized that although the drawings diagrammatically show components being above or below other components, the relative spatial arrangements are illustrative only. In an actual furnace, components may not be physically oriented exactly as shown, but the relative relationships along combustion gas flow path 42 may be as shown. In the same vein, references to upstream and downstream refer to fluid flow through combustion gas flow path 42.

Combustion blower 32 can be configured to produce a positive airflow in the direction indicated generally by arrow 40, forcing the combustion air within burner 12 to be discharged through flue 38. The change in the airflow 40 can change the air/fuel combustion ratio within burner 12, absent an equal change in gas flow from gas valve 18. In some cases, combustion blower 32 can include a multi-speed or variable speed fan or blower capable of adjusting the combustion air flow 40 between either a number of discrete airflow positions or variably within a range of airflow positions.

A controller 50 equipped with motor speed control capability can be configured to control various components of furnace 10, including the ignition of fuel by an ignition element (not shown), the speed and operation times of combustion blower 32, and the speed and operation times of circulating fan or blower 22. In addition, controller 50 can be configured to monitor and/or control various other aspects of the system including any damper and/or diverter valves connected to the supply air ducts, any sensors used for detecting temperature and/or airflow, any sensors used for detecting filter capacity, and any shut-off valves used for shutting off the supply of gas to gas valve 18. In the control of other gas-fired appliances such as water heaters, for example, controller 50 can be tasked to perform other functions such as water level and/or temperature detection, as desired.

In some embodiments, controller 50 can include an integral furnace controller (IFC) configured to communicate with one or more thermostat controllers or the like (not shown) for receiving heat request signals from various locations within the building or structure. It should be understood, however, that controller 50 may be configured to provide connectivity to a wide range of platforms and/or standards, as desired.

In some instances, as illustrated, furnace 10 may include a pneumatic sampling device 44 that may be considered as forming a portion of combustion gas flow path 42. As illustrated, pneumatic sampling device 44 is disposed upstream of combustion blower 32, and is located between combustion blower 32 and collector box 16. In other cases, pneumatic sampling device 44 may be located at any suitable location within combustion gas flow path 42. It will be appreciated, however, that in some cases, placing pneumatic sampling device 44 at or near the inlet to combustion blower 32 may provide a satisfactory pneumatic signal that is relatively noise-free.

Pneumatic sampling device 44 may include a first pressure port 46 and a second pressure port 48, which will be discussed in greater detail with respect to subsequent drawings. A restriction may be placed downstream of the first pressure port 46. A first pneumatic line 49 may provide fluid communication between first pressure port 46 and gas valve 18. A second pneumatic line 52 may provide fluid communication between second pressure port 48 and gas valve 18. It will be appreciated that a pressure change (increase or decrease) between first pressure port 46 and second pressure port 48 may be provided to, and used by, gas valve 18 to modulate the relative amount of fuel that is provided to burner 12.

It will also be appreciated that the pressure change (increase or decrease) may be controlled by modulating the speed of combustion blower 32. As such, and in some cases, the firing rate of furnace 10 may be controlled simply by controlling the speed of combustion blower 32. The speed of combustion blower 32 may cause a corresponding pressure change in pneumatic sampling device 44, which will deliver a corresponding pneumatic signal to gas valve 18. The pneumatic signal will then cause gas valve 18 to modulate the gas flow such that the desired firing rate, having the desired gas/air ratio, is produced in burner 12.

In some equipment installations, the pneumatic signals provided by pneumatic sampling device 44 may potentially include transient noise from burner transitions, changes in combustion blower speed, changes in the speed of circulating blower 22, and the like. In some cases, there may be benefit to including a pressure conditioning device between pneumatic sampling device 44 and gas valve 18. A pressure conditioning device may reduce transient noise in the pneumatic signals.

Illustrative but non-limiting examples of suitable pressure conditioning devices may be found in co-pending U.S. patent application Ser. No. 11/164,083, filed on Nov. 9, 2005 and entitled "NEGATIVE PRESSURE CONDITIONING DEVICE AND FORCED AIR FURNACE INCORPORATING SAME" and in co-pending U.S. patent application Ser. No. 11/565,458, filed on Nov. 30, 2006 and entitled "NEGATIVE PRESSURE CONDITIONING DEVICE WITH LOW PRESSURE CUTOFF". The entire disclosures of both applications are incorporated herein by reference.

Figure 2:
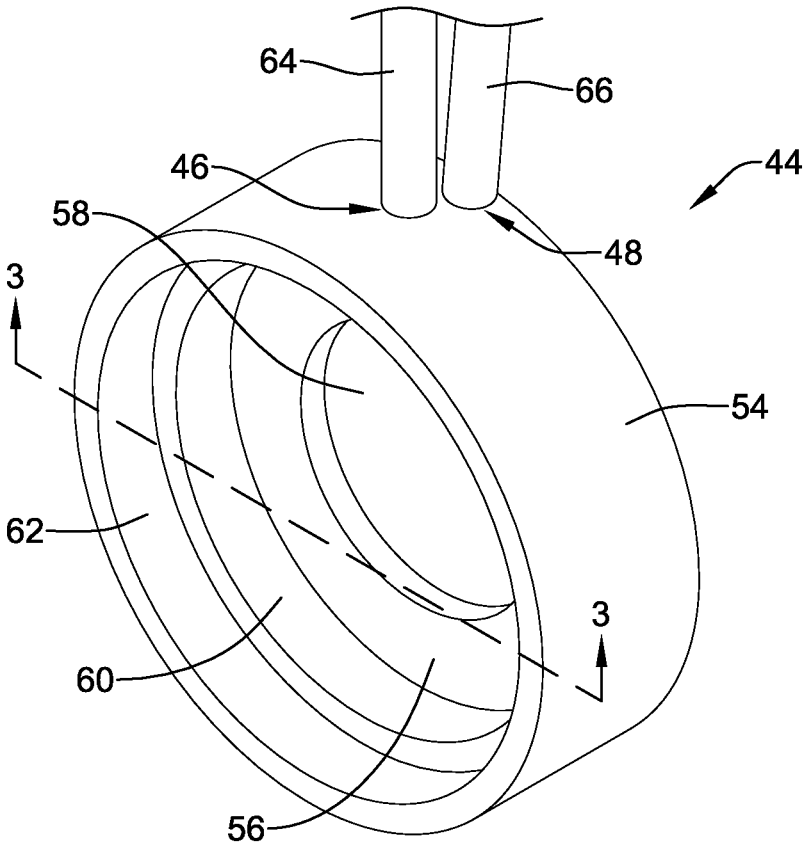
FIG. 2 is a perspective view of an illustrative but non-limiting pneumatic sampling device that may be used in conjunction with the furnace of FIG. 1.

FIG. 2 is a perspective view of an illustrative but non-limiting pneumatic sampling device 44. In some instances, pneumatic sampling device 44 may be considered as including a housing 54. As illustrated, housing 54 is cylindrical in shape, but in some cases housing 54 may take on a different outer and/or inner profile to accommodate a particular profile of a portion of furnace 10 (FIG. 1) to which it will be attached. The illustrative pneumatic sampling device 44 includes a restriction 56 that may be considered as a plate bearing an orifice 58. In some cases, the plate may be considered as being oriented perpendicular or at least substantially perpendicular to a direction of flow through orifice 58, but this is not required. As illustrated, housing 54 includes an annular surface 60 that may be sized for a particular application. In some cases, housing 54 may also include a flange 62 for attachment purposes, but this is not required.

Figure 3:
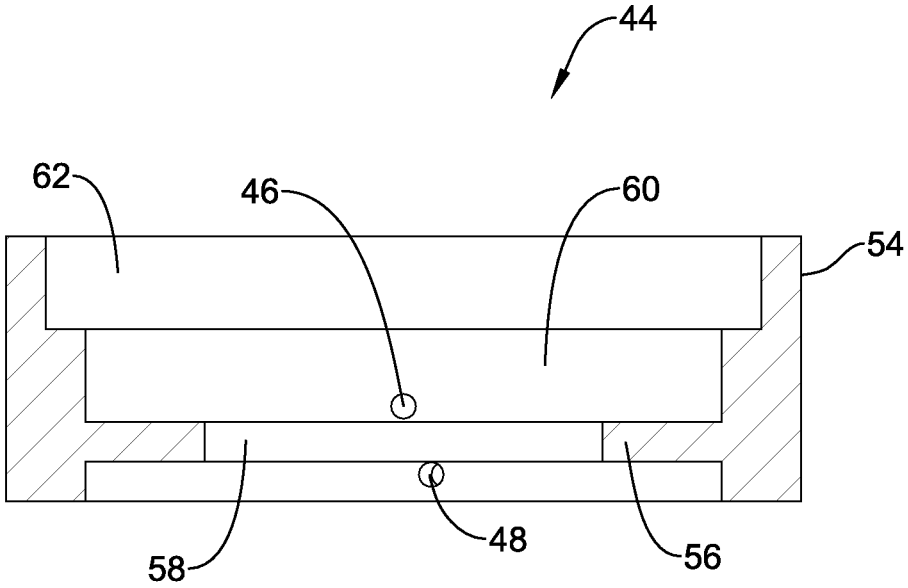
FIG. 3 is a cross-sectional view taken along line 3-3 of FIG. 2.

The illustrative pneumatic sampling device 44 includes first pressure port 46 and second pressure port 48, which are better seen in FIG. 3. FIG. 3 is a cross-sectional view taken along line 3-3 of FIG. 2. As illustrated, a flexible rubber hose 64 represents a manifestation of first pneumatic line 49 (FIG. 1) and a flexible rubber hose 66 represents a manifestation of second pneumatic line 52, but it will be appreciated that other types and materials or pneumatic lines may be employed. In some instances, first pressure port 46 and second pressure port 48 may be considered as being on opposing sides of restriction 56. If pneumatic sampling device 44 is disposed such that combustion gas flow path 42 (FIG. 1) extends through orifice 58, one of first pressure port 46 and second pressure port 48 may be considered as being upstream of restriction 56 while the other of first pressure port 46 and second pressure port 48 may be considered as being downstream of restriction 56.

Figure 4:
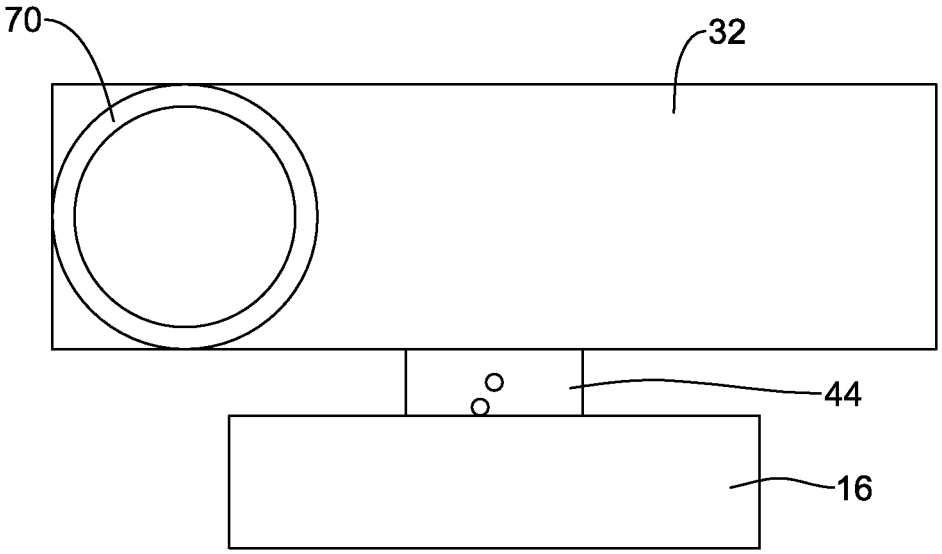
FIG. 4 is an elevation view of a portion of the furnace of FIG. 1.
Figure 5:
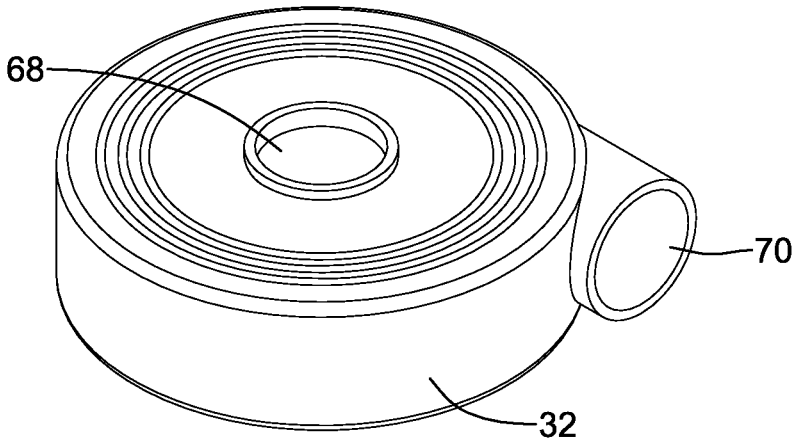
FIG. 5 is a perspective view of a portion of the furnace of FIG. 1.

In some instances, pneumatic sampling device 44 may be disposed between collector box 16 (FIG. 1) and combustion blower 32 (FIG. 1). FIG. 4 shows pneumatic sampling device 44 disposed directly between collector box 16 and an inlet (not seen in FIG. 4) of combustion blower 32. FIG. 5 provides a better view of combustion blower 32, which includes a combustion blower inlet 68. In some instances, pneumatic sampling device 44 may be configured to snap onto combustion blower inlet 68 and/or snap onto collector box 16. In some cases, pneumatic sampling device 44 may instead be molded or otherwise formed integral with combustion blower inlet 68, but this is not required. Returning to FIG. 4, a combustion blower outlet 70 may be configured to accommodate flue 38 (FIG. 1).

Figure 6:
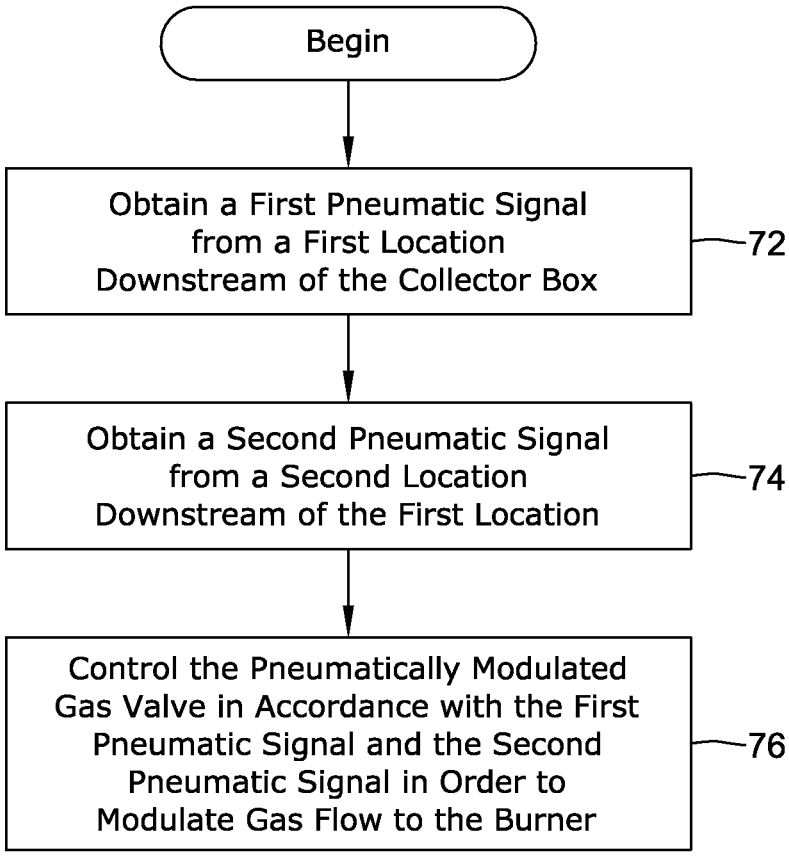
FIG. 6 is a flow diagram showing a method that may be carried out using the furnace of FIG. 1.

FIG. 6 is a flow diagram showing an illustrative method of operating furnace 10 (FIG. 1). Control begins at block 72, where a first pneumatic signal is obtained from a first location that is downstream of the collector box 16 (FIG. 1). At block 74, a second pneumatic signal is obtained from a second location that is downstream of the first location. In some instances, the first location and the second location may both be upstream of combustion blower 32 (FIG. 1). In some cases, the first pneumatic signal and the second pneumatic signal may be obtained at or near the inlet of a combustion blower, which is situated downstream of collector box 16. The first location may be upstream of a restriction 56 (FIG. 2), and the second location may be downstream of restriction 56. In some cases, the second location may be coincident with the restriction. That is, the restriction may extend downstream past the second location, if desired.

In some cases, the first pneumatic signal may be obtained from either first pressure port 46 or second pressure port 48 (FIG. 2), depending on the orientation of pneumatic sampling device 44 relative to combustion gas flow path 42 (FIG. 1), and the second pneumatic signal may be obtained from the other of first pressure port 46 or second pressure port 48. As noted at block 76, gas valve 18 may be controlled or otherwise operated in accordance with the first pneumatic signal and the second pneumatic signal in order to modulate gas flow to burner 12.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

I claim:

1. A forced air furnace comprising:

a burner;

a pneumatically modulated gas valve configured to provide gas to the burner;

a combustion blower in fluid communication with the burner; and a pneumatic sampling device disposed proximate the combustion blower, the pneumatic sampling device having a first pneumatic sampling port in fluid communication with the pneumatically modulated gas valve via a first pneumatic line for providing a first pneumatic signal directly to the pneumatically modulated gas valve, and a second pneumatic sampling port in fluid communication with the pneumatically modulated gas valve via a second pneumatic line for providing a second pneumatic signal directly to the pneumatically modulated gas valve, the first and second pneumatic signals collectively representative of fluid flow through the pneumatic sampling device, the pneumatically modulated gas valve regulating gas flow in accordance with the first and second pneumatic signals.

2. The forced air furnace of claim 1, wherein the pneumatic sampling device is disposed upstream of the combustion blower.

3. The forced air furnace of claim 1, further comprising a collector box, the collector box is disposed in fluid communication between the burner and the combustion blower.

4. The forced air furnace of claim 3, wherein the pneumatic sampling device is disposed in fluid communication between the collector box and the combustion blower.

5. The forced air furnace of claim 4, wherein the pneumatic sampling device is in contact with an exterior of the collector box and an exterior of the combustion blower.

6. The forced air furnace of claim 3, wherein a combustion gas flow path extends from the collector box to the combustion blower, and the pneumatic sampling device is configured to form a portion of the combustion gas flow path from the collector box to the combustion blower.

7. The forced air furnace of claim 3, wherein the pneumatic sampling device comprises an annular housing and a restriction disposed within the annular housing.

8. The forced air furnace of claim 7, wherein, the first and second pneumatic sampling ports are arranged to collectively sample a pressure change across the restriction.

9. The forced air furnace of claim 8, wherein one of the first and second pneumatic sampling ports is disposed upstream of the restriction and another of the first and second pneumatic sampling ports is disposed downstream of the restriction.

10. A combustion appliance comprising:

a burner;

a pneumatically modulated gas valve configured to provide gas to the burner;

a combustion blower having a combustion blower inlet;

a restriction disposed in fluid communication with the combustion blower;

a first pressure port disposed upstream of the restriction; and a second pressure port disposed downstream of the restriction;

wherein the first pressure port and the second pressure port are in fluid communication with the pneumatically modulated gas valve, wherein the pneumatically modulated gas valve receives pressure signals directly from the first and second pressure ports.

11. The combustion appliance of claim 10, wherein the restriction is upstream of the combustion blower.

12. The combustion appliance of claim 11, further comprising a collector box positioned upstream of the combustion blower, the restriction disposed between the collector box and the combustion blower.

13. The combustion appliance of claim 10, wherein the restriction comprises a plate and an orifice disposed within the plate, the plate disposed perpendicular or substantially perpendicular to fluid flow.

14. The combustion appliance of claim 13, wherein the first pressure port is proximate the plate but disposed upstream of the plate.

15. The combustion appliance of claim 13, wherein the second pressure port is proximate the plate but disposed downstream of the plate.

16. The combustion appliance of claim 13, wherein the restriction comprises a hollow structure with the plate disposed within the hollow structure.

17. The combustion appliance of claim 16, wherein the hollow structure includes a shape that is complementary to a shape of the combustion blower inlet.

18. The combustion appliance of claim 10, wherein the restriction is molded into the combustion blower inlet.

19. A method of operating a modulating combustion appliance having a pneumatically modulated gas valve, a burner, a combustion blower and a collector box, the method comprising the steps of:

delivering a first pneumatic signal from a first location downstream of the collector box directly to the pneumatically modulated gas valve via a first pneumatic sampling port and a first pneumatic line;

delivering a second pneumatic signal from a second location downstream of the first location directly to the pneumatically modulated gas valve via a second pneumatic sampling port and a second pneumatic line; and controlling the pneumatically modulated gas valve to modulate gas flow to the burner based on the first pneumatic signal and the second pneumatic signal.

20. The method of claim 19, wherein the first location and the second location are upstream of the combustion blower.

21. The method of claim 19, wherein the combustion appliance further comprises a restriction disposed between the collector box and the combustion blower, and the first location is upstream of the restriction while the second location is downstream of the restriction.

* * * * *